United States Patent [19]

Abbondante

[11] 4,013,851

[45] Mar. 22, 1977

[54] VEHICLE DETECTION APPARATUS

[75] Inventor: Cosmo Abbondante, Burlington, Mass.

[73] Assignee: Bofors America, Inc., Linden, N.J.

[22] Filed: July 25, 1975

[21] Appl. No.: 598,930

[52] U.S. Cl. ..... 200/86 R
[51] Int. Cl.[2] ..... H01H 13/16
[58] Field of Search ..... 200/86 R; 340/272

[56] References Cited

UNITED STATES PATENTS

| | | | |
|---|---|---|---|
| 2,165,227 | 7/1939 | Cooper | 200/86 R |
| 2,761,928 | 9/1956 | Cooper et al. | 340/272 |
| 2,796,488 | 6/1957 | Cooper | 200/86 R |
| 2,896,042 | 7/1959 | Koenig | 200/86 R |

*Primary Examiner*—David Smith, Jr.
*Attorney, Agent, or Firm*—James E. Mrose

[57] ABSTRACT

Vehicle-detection apparatus, for installation at highway toll-booth, parking-area, and like sites, includes elongated thin-strip electrical switching sensors disposed near a road surface and oriented transversely to traffic directions, for responses to tire-transmitted loadings, the switching sensors each being in the form of a pair of narrow highly-elongated flat conductive strips, at least the upper one of which is springy and both of which are cartridged in a minutely-spaced substantially parallel relationship within a shallow open-topped flat-bottomed rigid channel member, the minute spacing being maintained by plastic insulating tape sandwiched between the strips only near their edges; the plural sensors are cast into a tough but somewhat flexible plastic mass in side-by-side relationship atop a stiff backing plate, with the upper strip being parted from the mass by a thin plastic sheathing, and the top surface of the cast assembly is rendered non-skidding by way of abrasive particle embedments.

9 Claims, 8 Drawing Figures

VEHICLE DETECTION APPARATUS

BACKGROUND OF THE INVENTION

The present invention relates to improvements in weight-responsive vehicle detection apparatus, and, in one particular aspect, to novel and improved electrical-switching type sensors of uncomplicated low-cost construction and of thin highly-elongated strip form which are highly rugged and will reliably make and break advantageously broad-area non-sliding contacts under both light and severe loadings, including those attended by transverse acceleration or braking forces, as the result of a unique compact low-profile cartridged construction involving an open-topped channel in which an edge-mounted narrow flexible upper switch blade is normally maintained in a very minute spacing from a contact strip below it by thin plastic edge spacer material, the upper blade being locally deflectable in response to vehicle tire loadings transmitted to it through a cast bed of flexible surfacing from which it is parted by a suitable film.

Vehicle sensors of a variety of types have been known heretofore, including those which rest upon or are recessed below a roadway for such purposes as signalling the presence of a vehicle, counting their numbers, or automatically actuating a barrier and/or ticket-dispensing machine at parking garages, toll highways and like places. Familiar examples are the cable-like pressure-responsive detectors used at most filling stations to signal attendants or temporarily draped across roadways to gather traffic data. When the detector installations are to be substantially permanent, they are expected to withstand the rigors of shock, vibration, and skid or tire-spin forces, as well as extremes of temperature, moisture and contamination, while nevertheless accurately and reliably sensing each application and removal of tire-induced loading by all vehicles from the lightest to heaviest of common weights. Earlier proposals have included simple electricaL contacting members, fluid-filled actuator tubes, and deformable members equipped with strain gages, and it has been known to implant such detectors below the level of a roadway within a yieldable mass, such as one of vulcanized rubber which is positioned essentially flush with the road surface.

In sophisticated vehicle-sensing systems, the detections may be required to exhibit a "logic" which can be employed by associated electronic circuitry to prevent drivers or attendants from interfering with the intended system functions, for such purposes as escaping a proper toll. A plurality of narrow elongated detectors, installed in spaced parallel relationship across a lane, can develop a pattern or logic of signals rendering a revenue-control system immune to such cheating, despite evasive vehicle maneuvers, but it then becomes quite important that the detector signals be positive, rapid and sharp. Simple electrical contacting or switching is theoretically appropriate, although in practice it is very difficult to make, hold and break connections cleanly and sensitively, and to avoid shortings or irregularities due to particle build-up resulting from wear; contact contaminations, particularly as a consequence of "pumping" actions within compressible switching cavities, are also a source of difficulty.

The improved and unusual vehicle-detection apparatus with which the present invention is concerned are also of the latter type, namely those in which electrical switching is effected, and in which such switching is of a quality and reliability appropriate to interfacing with revenue-control logic systems. Toward those ends, the sensors are rendered highly durable and resistant to extremes of loading and abuse, while at the same time being of mechanical nicety and operational sensitivity appropriate to ease of manufacture and reliability of signalling; moreover, electrical contacting is rendered substantially immune to wear, and very minute contact spacings, inherently promoted by the configuration and assembly of contacts, minimize difficulties brought on by pumping actions.

SUMMARY

A preferred vehicle-detection assembly in accordance with the present teachings comprises a set of highly-elongated sensor cartridges, such as four, each less than two inches wide and in excess of eight feet in length, which are disposed in closely-spaced side-by-side parallel relationship atop a substantially stiff metal baseplate of slightly greater length, the baseplate with superpositioned cartridges being cast, together with electrical connection leads from the cartridges, within a sealing and isolating mass of tough and yieldable plastic material, such as a poly ether urethane. Each of the cartridges includes a narrow, thin and elongated channel member which serves to hold a pair of correspondingly narrow and elongated overlapped contact strips or blades, the channel members preferably being aluminum extrusions which are open-topped with inwardly-turned edges only slightly spaced from a flat base, and the contact strips each being very thin and substantially flat electrically-conductive elements about twenty-five thousandths of an inch thick, at least the upper one of the overlapped contact strips being of a springy metal such as phosphor bronze. Vertical spacing between the two contact strips is intentionally kept minute, such as a spacing of the order of about fourteen thousandths of an inch, and is developed by sandwiching of relatively narrow and thin plastic insulating tape or film between and strictly confined close to the two long edges of the contact strips. Narrow tabs, integral with the strips and projecting outwardly from ends of the channel members into which the sandwiched contact strips and spacer material have been inserted, are joined with the electrical connection leads to characterize open and closed conditions of the switches formed within each cartridge. The exposed upper surface of the springy upper contact strip or switch blade is in each instance maintained free of any bonded relationship to the bordering yieldable plastic mass into which the baseplate-supported cartridges are cast, preferably by a "parting" film of plastic such as Mylar. When the cast assembly is flush-recessed into a highway, with the direction of cartridge elongation transverse to the direction of traffic, each tire of a crossing vehicle transmits loading force through the yieldable plastic mass and onto the immediately-underlying part of the upper surface of the upper switch blade below it, causing that part of the blade to assume a localized but nevertheless broad-area concave or depressed shape transversely to its direction of elongation, with a resulting positive and broad-area non-wiping electrical contacting with the lower contact strip. Upon removal of the force as the tire moves on, the upper blade immediately restores itself to a flat condition in which it is spaced from the lower contact strip, without any significant wear-inducing wiping action. Highly-elongated switch blades with minute spacing between them are prone to making unwanted contact when they are flexed or buckled even slightly along their direction of elongation, and this tendency is resisted by the rigid baseplate as well as by limited freedom of the upper blade to slip longitudinally within its cartridge. Spurious forces tend to be non-destructive.

Accordingly, it is one of the objects of the present invention to provide novel and improved vehicle sensors which yield clean and reliable switching signals in response to forces applied by tires, and yet which exhibit a high degree of mechanical nicety reflected in economical manufacture and resistance to effects of wear and abuse, as the result of unique assemblies of minutely-spaced highly-elongated switch contacts within rigidly-backed cartridges disposed within a mass of yieldable force-transmitting material.

Another object is to provide advantageously uncomplicated and highly rugged vehicle detectors of an electrical switching type which develop positive and precise closures and separations of contacts of narrow elongated form having exceedingly small spacing therebetween, the detectors being sensitive in operation while at the same time being well isolated from damage due to spurious forces, and operating in a manner which minimizes disabling effects of contamination and heavy prolonged usage, and involving virtically no intricacy or critical delicacy of manufacture.

BRIEF DESCRIPTION OF THE DRAWINGS

Although the aspects and features of this invention which are considered to be novel are expressed in the appended claims, further details as to preferred practices and as to the further objects and features thereof may be most readily comprehended through reference to the following description of preferred embodiments taken in connection with the accompanying drawings, wherein:

DESCRIPTION OF THE PREFERRED EMBODIMENTS

Figure 1:
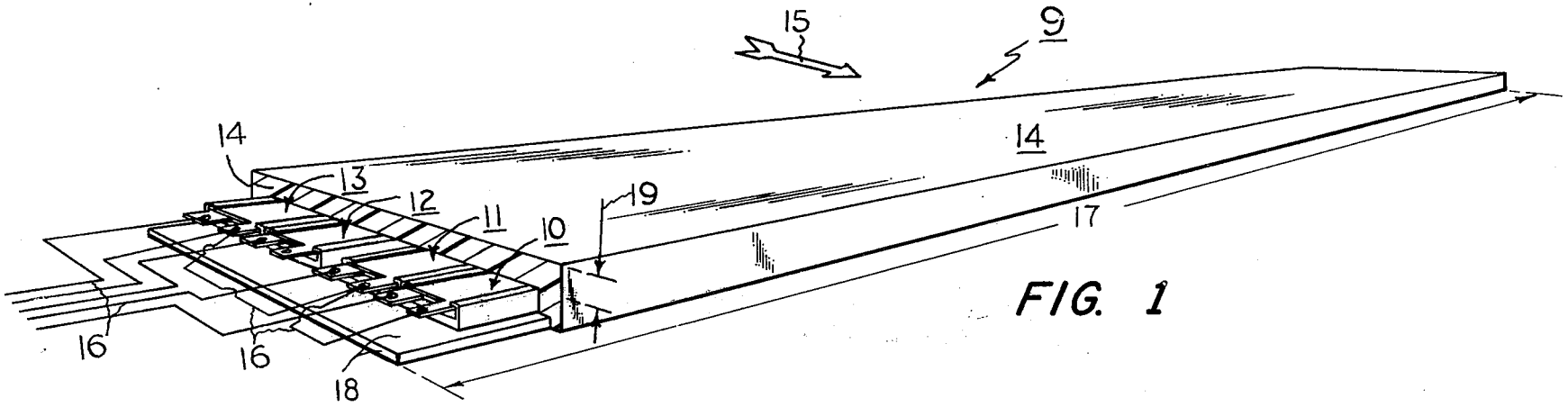
FIG. 1 is a perspective view, with portions broken away to expose interior constructional detail, of a cast assembly of improved vehicle sensors.

The vehicle detection apparatus 9 appearing in FIG. 1 is of a multiple-sensor type wherein four narrow and highly elongated switching cartridges or sensors, 10 through 13, are disposed parallel with one another within an elongated mass or block of tough and somewhat yieldable plastic 14, the entire assembly being intended for an orientation essentially flush with a road surface and substantially transverse to a direction of vehicular traffic, represented by arrow 15. Each of the four sensors comprises an electrical switching subassembly, and associated switch contact tabs project outwardly therefrom at a common end where they can be connected with electrical leads such as 16 which in turn are interconnected externally with automatic electrical equipment of known form, not shown, for signalling and/or calculating in response to detections of forces applied to the apparatus by vehicle tires as they cross over it. The entire assembly has a length 17 which may typically run from about 8 to 10 feet, and is rendered stiff overall by a flat metal baseplate 18 onto which the cartridges are set and adhesively bonded with it. Baseplate 18 may typically be of steel, about one quarter inch thick, and nearly 1 foot wide, and preferably afford an electrical cable connector mounting, not shown, for leads 16. The cast mass of somewhat flexible plastic material 14 preferably covers and seals with all exposed surfaces of the baseplate, connections and cartridges, except that, as is further described later herein, the upper switch blade surfaces for each cartridge are parted from the plastic mass rather than being integrally bonded with it. One highly satisfactory plastic material for the casting is a black polyether urethane, having a 55–60 durometer rating, and its thickness, 19, above the level of the cartridges is about 0.35 inch in one suitable construction.

Figure 2:
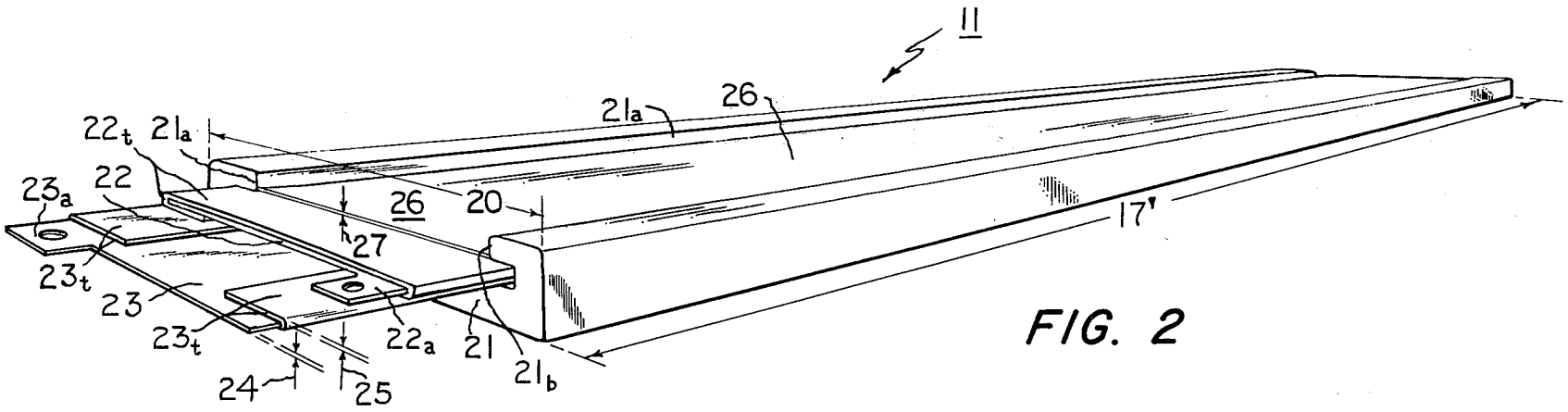
FIG. 2 provides a perspective view of one of the sensors appearing in the assembly of FIG. 1.

One of the sensors, 11, is shown fully exposed, in FIG. 2, its length 17' being only slightly less than the overall length of apparatus 9, and the width 20 of its extruded aluminum channel member 21 being only about 1.8 inch. Channel 21 is flat-bottomed and open-topped, preferably with narrow inwardly-directed lips or margins **21*a* and 21*b*, as illustrated, which form edge slots into which the two thin, narrow and highly-elongated flat switch contacts or blades 22 and 23 may be slid, together with marginal insulating spacer material. Both switch blades are of electrically-conductive material, and are of about the same small thickness, 24, preferably about 0.025 inch. However, at least the upper blade, 22, should have a high degree of springiness which will enable it to restore itself to a flat condition after having been depressed transversely; phosphor bronze or berrylium copper and stainless steel offer both that quality and good electrical conductivity. Both blades have integral end tabs, 22*a* and 23*a*, to which external electrical connections can readily be made, and the tabs in each such pair are laterally offset from one another to minimize shorting possibilities. In a typical assembly, the blades are each about 1.56 inch wide, and, with lengths about 8 feet, the length-to-width ratio is over 60. For some purposes, such as meeting the requirements of associated electrical equipment served by the switches, both blades should be insulated from the channel member and baseplate, as well as from one another, such that both the bottom and top blades 22 and 23 are provided with certain insulating-tape or film wrappings, 22*t* and 23*t*. A pliable adhesive-type plastic tape, having a thickness, 25, of about 0.007 inch, including a 0.001 inch Mylar layer on the outside, serves the insulating and spacing needs of the assembly very well. Tape layer 22*t* is applied across the upper surfaces of upper blade 22, and fully around its long edges, and overlaps both bottom lateral edge surfaces of blade 22 by about one-eighth inch. Tape layer 23*t* is correspondingly applied across all bottom surfaces of bottom contact 23, and fully around its long edges, and overlaps both top lateral edge surfaces of blade 23 by about ¼ inch. Each such insulating layer is applied and caused to adhere before the two blades are paired with their exposed conductive surfaces face-to-face, and the two are then slid into mated relationship with the channel member, there being just sufficient clearance between them and the inner surfaces of the channel member to allow that assembly and yet establish a good mechancial hold and integrity of the cartridge subassembly once it is completed. Before each cartridge is cast within the mass or pad of plastic 14, a strip of Mylar film or the like, 26, of about 0.003 inch thickness, 27, is loosely applied over substantially the full exposed upper surface of the tape-covered upper switch blade 22, to insure that good mechanical "parting" exists between that cast plastic and the upper blade 22**.

Figure 3:
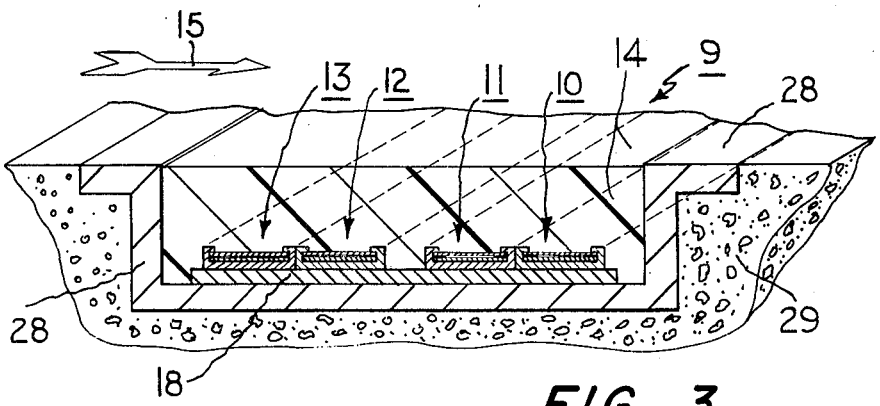
FIG. 3 comprises a transverse cross-section of the improved vehicle-sensor assembly mounted in a roadbed.

When applied to a roadbed, assembly 9 may be disposed within a rigid metal flanged holder or frame, 28, of accommodating configuration which has been let into concrete, 29, or other roadbed material, as illustrated in FIG. 3. Preferably, mass 14 projects very slightly above the road level, and its upper surface is shaped or textured to promote an acceptable friction which tends to minimize skidding; for the latter purpose, particles of sand or like materials may be added at least to the upper portion of the cast mass.

Figure 4:
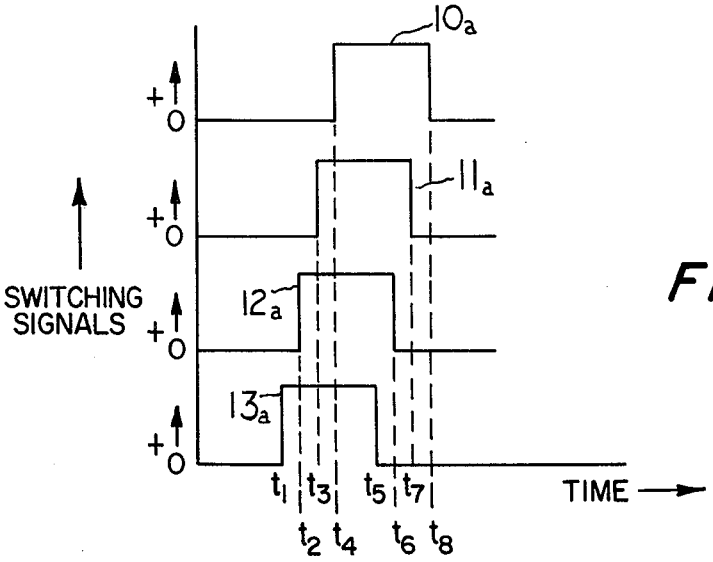
FIG. 4 graphically portrays an electrical switching sequence for an assembly such as that of FIGS. 1 and 4, and expressing related logic for automatic processing.
Figure 5:
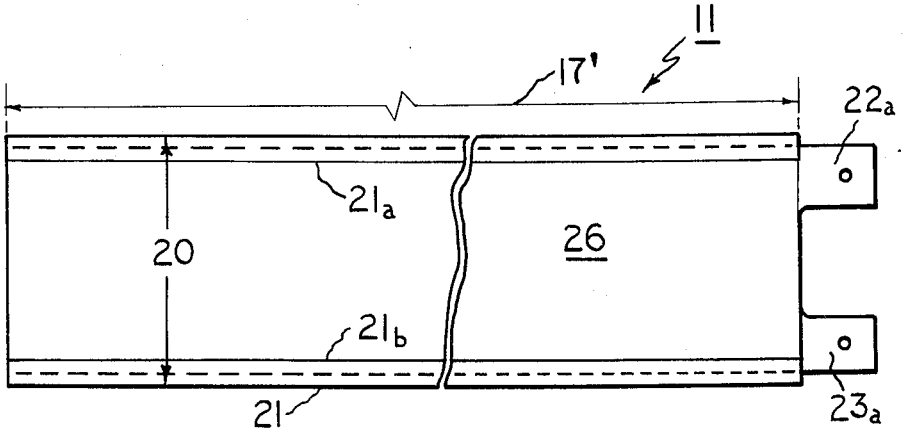
FIG. 5 is a plan view of a sensor such as that of FIG. 2.

Each sensor tends to make and break electrical contacting quite positively and rapidly, while sustaining clean shorted or unshorted conditions, as the case may be, during intervals in between. Their responses are predominantly to vertically-imposed forces applied by tires, with each sensor functioning essentially independently rather than all being opened and closed simultaneously. Accordingly the rolling passage of one vehicle tire across the assembly in direction 15 yields a readily-discernible pattern of contact connections and disconnections, such as is approximately characterized graphically in FIG. 4, the common abscissa there representing time and the ordinates the electrical signals switched by the sensors. At time $t_1$, sensor 13 occasions signal 13*a*, followed by signal 12*a* from sensor 12 at time $t_2$, and by signal 11*a* from sensor 11 at time $t_3$, and by signal 10*a* from sensor 10 at time $t_4$. Subsequently, as the tire rolls further, these switches open and the related signals are interrupted in a similar sequence, characterized by the changes at times $t_5$ through $t_8$. The "logic" afforded by such sequencing conveniently lends itself to automatic processing by associated electronic equipment, such that efforts to deceive the detection and escape revenue control can be foiled. In other arrangements, the lateral spacings between sensors may be varied to affect the logic appropriately, and it is noted collaterally that sensors 11 and 12 have a greater separation than the other adjacent sensors, although that factor is neglected in the plots of FIG. 4.

Figure 6:
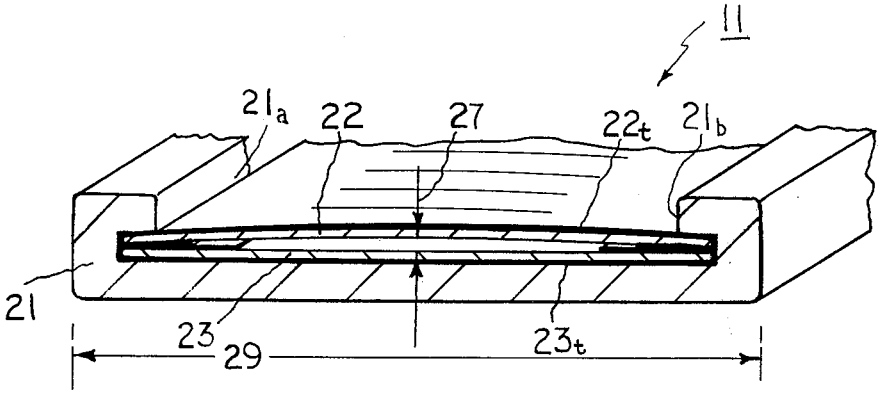
FIG. 6 provides a cross-section of an improved sensor, in a non-contacting condition.
Figure 7:
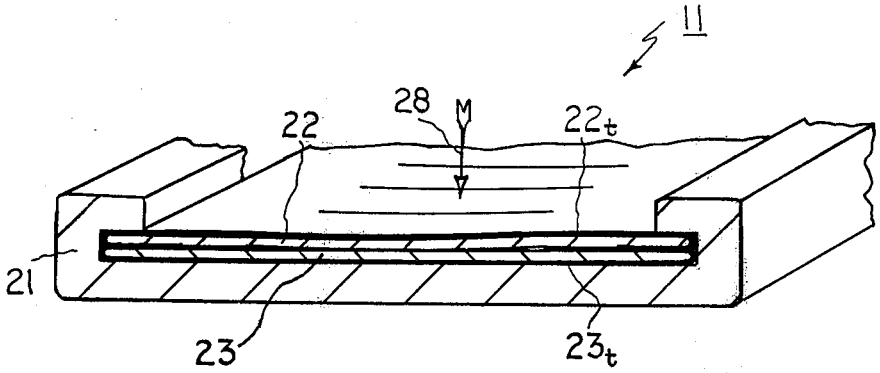
FIG. 7 provides a cross-section of the same sensor in a shorted switching state.

The corss-sections in FIGS. 6 and 7 characterize open and closed conditions for a sensor such as item 11. Normally, the upper switch contact or blade 22 is substantially flat, or selected such that any normal cylindrically-curved bowing, as shown, is arched upwardly away from the flat lower contact 23. If the latter possesses any such bowing, it is disposed downwardly, away from the upper contact. When it is desired that a slight cylindrically-curved bowing of upper contact 22 appear, it may be induced by having that contact make a snug fit with the inner-side walls of channel member 21 and by crimping or otherwise mechancially depressing the inwardly-projecting overhanging edges or lips 21*a* and 21*b* of channel member 21. Whether flat or upwardly bowed, the broad-area lower exposed conductive surfaces of upper contact 11 normally tend to maintain a separation from the confronting upper exposed surfaces of lower contact 23, that separation 27, in FIG. 6, being at least about equal to the combined thicknesses of the two narrow insulating edge-tapings developed by coverings 22*t* and 23*t*, i.e., about 0.014 inch. Upon receiving a tire-transmitted force through the padding of flexible mass 14, such as a force in the direction of arrow 28 in FIG. 7, the upper contact 22 is depressed and bowed downwardly ainto non-wiping contact with the lower contact, thereby establishing the intended closure of switch contacts, such closure being positive and of relatively low resistance because of the broad-area contacting involved. Upper contact 22 immediately springs back to a non-contacting orientation when tire forces are no longer applied to the apparatus. Both the closures and openings occur substantially without any wiping action between the contact surfaces involved, and that important characteristic avoids wear and build-up of conductive particles which could cause shorting. In addition, the fact that such minute contact spacing is involved also results in only very small "pumping" tendencies as the low-volume switching cavity is squeezed and relaxed; where large volumes and a high level of such "pumping" occurs, the entire assembly tends to "breathe" in contaminants, including moisture, dirt and corrosive substances, from outside, particularly if the sealing is faulty or weak or if the sealing mass is one which can emit undersirable substances, such as sulfides which may be given off by a rubber mass. A currently-preferred construction utilized a channel member having a width, 29 (FIG. 6), of about 1.812 inches, and edge slotting about 0.094 inch high to receive the taped edges of the contact blades. The blades, about 1.560 inches wide and 0.025 inch thick, fit snugly within the channel member.

In manufacture, the sensor cartridge sub-assemblies are bonded to the rigid baseplate, with electrical connections being made to the contacts in whatever pattern is appropriate to the intended use with associated electrical circuitry; the number of sensors may vary, and in some instances only a single sensor may be involved. Both of the small open ends of the sensors are then sealed, externally, with a build-up or bead of putty-like adhesive, such as that commercially available under the designation RTV 3145, the sealing at one end including a vent tube coupled with the switching cavities. The sealed assembly is then cast into the polyether urethane mass 14 at a suitably elevated temperature, the vent tube being used to draw dry external air into the switching cavities to prevent their becoming evacuated and possibly causing shorting; thereafter, the vent is sealed off, permanently. Although not illustrated, the yieldable mass into which the sensors are molded may pad the underside of the baseplate, as well as the regions above the sensors. Sensitivity may be varied by selecting upper switch blades which are relatively thick or thin, and the padding of yieldable material above the sensors may be varied in thickness also.

Figure 8:
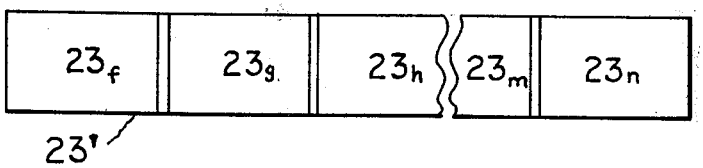
FIG. 8 represents a segmented bottom contact arrangement for an alternative sensor embodiment.

Counting of the numbers or sets of wheels per axle of a crossing vehicle may be effected with the aid of a lower contact structure for each sensor which has relatively short electrically-separated parts along its length, the sensor construction otherwise being substantially as described, except that separate electrical connections are of course made to the separated parts. FIG. 8 illustrates the form of such a lower-contact structure, 23', which has electrically-isolated conductive parts **23*f* through 23*n***.

The self-contained sensor sub-assemblies have a high degree of structural integrity which aids in rendering the apparatus largely immune to forces other than those of proper loading in the vertical direction. Wheel spins, accelerations and braking, which can be destructive of or render other sensors inoperative, have little untoward effect upon the improved apparatus, because none of the sensor blades is integral with the flexible mass above them. In modified constructions, the switch blades may have electrically-conductive surfacing added to various materials which constitute major portions of one or both of the blades, including non-metallic materials. Or, where grounding is not an electrical-system problem, the channel member itself may serve as a lower contact, without a separate lower contact strip being added to it. Similarly, the upper contact blade of a pair may be in direct mechanical and electrical connection with the channel member, with only the lower blade being insulated and electrically isolated.

Accordingly, it should be understood that the specific practices and preferred embodiments herein referred to have been offered by way of disclosure rather than limitation, and that various modifications, additions and substitutions may be effected by those skilled in the art without departure from these teachings; it is therefroe aimed in the appended claims to embrace all such variations as fall within the true spirit and scope of this invention.

What I claim as new and desire to secure by Letters Patent of the United States is:

1. Apparatus for closing an electrical circuit during application of force by a vehicle tire or the like, comprising a relatively thin, narrow and elongated contact member having a flexibility which tends to preserve a substantially flat condition thereof following its bending transverse to its direction of elongation, substantially rigid holder means having an elongated open-topped shallow channel therein, said contact member being fitted within said channel with long edges of said member confined against lateral movement thereby, said contact member having electrically-conductive lower surfaces disposed opposite substantially flat electrically-conductive upper surfaces within said channel, thin and narrow elongated spacer means under the long margins of said contact member and confined to the marginal areas thereof, said spacer means normally maintaining a relatively minute spacing between said electrically-conductive surfaces while permitting said lower surfaces to be deflected into non-wiping broad-area engagement with said upper surfaces upon application of force to the top of said contact member, substantially yieldable means padding the areas above said top of said contact member and transmitting forces applied thereto to said contact member, said yieldable means being in continguous unbonded relationship with said top of said contact member, and means making separate electrical connections with said electrically-conductive surfaces.

2. Apparatus as set forth in claim 1 wherein said contact member comprises a springy material having good electrical conductivity wherein said holder comprises an elongated channel-shaped member supported on a rigid metal baseplate, wherein said electrically-conductive upper surfaces within said channel are surfaces of a second narrow elongated contact member disposed within said channel, and wherein said spacer means comprises a spaced pair of thin narrow and elongated layers of insulating material between said contact members near the edges thereof.

3. Apparatus as set forth in claim 2 wherein said layers are of plastic tape, wherein said contact members are of substantially the same width, and wherein the width of each of said layers of tape is but a small fraction of said width of said contact members.

4. Apparatus as set forth in claim 3 wherein said layers of plastic tape are integral with tape covering the edges and surfaces of one of said contact members other than surfaces disposed for said engagement.

5. Apparatus as set forth in claim 4 wherein said layers of plastic tape are integral with tape covering the edges and surfaces of each of the two contact members other than surfaces disposed for said engagement, and wherein the tape-covered contact members fit closely within said channel-shaped member and are confined against lateral movement thereby.

6. Apparatus as set forth in claim 1 wherein said yieldable means comprises a mass of molded polyether urethane material having a durometer rating of the order of about 55–60, wherein said material seals the assembly of said holder means and contact member while leaving said minute spacing unfilled and further including a layer of plastic noon-adhesively resting atop said contact member and serving to part said member from said yieldable means.

7. Vehicle detection apparatus, comprising a plurality of like electrical switching sensor sub-assemblies each of shallow, narrow and highly-elongated form, a substantially rigid baseplate, asaid sensor sub-assemblies being mounted alongside one another in parallel relationship on said baseplate, each of said sensor sub-assemblies including a narrow, shallow and highly-elongated open-topped channel member, a relatively thin and narrow highly-elongated contact member of electrically-conductive material having a flexibility which tends to preserve a normally substantially flat condition thereof following its bending transverse to its direction of elongation, said contact member being fitted within said channel member with long edges of said member confined against lateral movement thereby, said contact member having its lower surfaces disposed opposite substantially flat electrically-conductive upper surfaces within said channel, and relatively thin and narrow elongated spacer means under the long margins of said contact member and confined to the marginal areas thereof, said spacer means normally maintaining a relatively minute spacing between said lower and upper surfaces while permitting said contact member to be deflected downwardly for non-wiping broad-area engagement of its lower surfaces with said upper surfaces upon application of force to the top of said contact member, and a substantially yieldable mass of material molded over said baseplace and all of said sensor sub-assemblies said yieldable mass being in contiguous unbonded relationship with the tops of all of the said contact members, means making separate electrical connection with the contact member and electrically-conductive surfaces of each of said sub-assemblies, and means for mounting the molded assembly of said baseplate and sensor sub-assemblies along a traffice lane for crossings of said yieldable mass by tires of vehicles travelling in direction transverse to said direction of elongation, whereby forces applied to said yieldable mass by vehicle tires are transmitted to the tops of said contact members and deflect said contact members transversely to said direction of elongation and into said non-wiping broad-area engagement.

8. Vehicle detection apparatus as set forth in claim 7 wherein each said channel member comprises an extruded metal channel having narrow inwardly-projecting lips at the top edges thereof, wherein each of said upper conducting surfaces is formed by an electrically-conductive strip of substantially the same width as said contact member, wherein said spacer means is formed by electrically-insulating tape around the edges of each of said contact members and each of said strips and covering all surfaces thereof except said oppositely-disposed surfaces, and wherein each taped pair of a contact member and strip is slid into mated relationship with a channel member and held in place by said lips thereof.

9. Vehicle detection apparatus as set forth in claim 8 wherein said mass comprises molded polyether urethane material having a durometer rating of the order of about 55–60, wherein said material seals said subassemblies while leaving the minute spacing between each contact member and strip unfilled, and further including thin plastic material non-adhesively resting atop all of the said contact members and serving to part said contact members from said molded material, and wherein said minute spacing is of the order of about 0.014 inch.

* * * * *